US005949395A

United States Patent [19]

Stevens et al.

[11] Patent Number: 5,949,395

[45] Date of Patent: Sep. 7, 1999

[54] FLAT-PANEL MATRIX-TYPE LIGHT EMISSIVE DISPLAY

[75] Inventors: Jessica L. Stevens, San Mateo; W. Edward Naugler, Jr., Menlo Park, both of Calif.

[73] Assignee: Telegen Corporation, San Mateo, Calif.

[21] Appl. No.: 08/576,641

[22] Filed: Dec. 21, 1995

[51] Int. Cl.[6] ..... H01J 29/00

[52] U.S. Cl. ..... 345/75; 313/496

[58] Field of Search ..... 345/75; 313/495, 313/496, 497; 315/169.1, 169.3, 366

[56] References Cited

U.S. PATENT DOCUMENTS

| | | | |
|---|---|---|---|
| 4,045,704 | 8/1977 | Kishino et al. | 313/497 |
| 4,049,993 | 9/1977 | Kishino et al. | 313/497 |
| 4,158,794 | 6/1979 | Sandler | 315/169.1 |
| 4,459,514 | 7/1984 | Morimoto et al. | 315/169.1 |
| 4,563,613 | 1/1986 | Genovese et al. | 313/497 |
| 4,678,967 | 7/1987 | Kadota | 313/497 |
| 4,794,306 | 12/1988 | Tischer et al. | 315/169.3 |
| 4,868,555 | 9/1989 | Watanabe et al. | 340/783 |
| 5,015,912 | 5/1991 | Spindt et al. | 313/495 |
| 5,055,744 | 10/1991 | Tsuruoka | 315/169.1 |
| 5,140,230 | 8/1992 | Tomii et al. | 315/366 |
| 5,170,100 | 12/1992 | Shicao et al. | 315/366 |
| 5,229,691 | 7/1993 | Shicao et al. | 315/366 |
| 5,315,213 | 5/1994 | Kim | 315/169.1 |
| 5,371,437 | 12/1994 | Amano | 315/169.1 |
| 5,548,185 | 8/1996 | Kumar et al. | 313/495 |
| 5,557,177 | 9/1996 | Engle | 315/366 |
| 5,565,742 | 10/1996 | Shicao et al. | 315/366 |
| 5,611,719 | 3/1997 | Vickers et al. | 445/24 |

*Primary Examiner*—Mark R. Powell
*Attorney, Agent, or Firm*—Victoria S. Kolakowski

[57] ABSTRACT

A flat-panel, matrix-type visible light emissive display which has an electron source positioned at the back panel for providing a background of electrons. An electron gating grid having a number of conductive filaments is positioned before the front panel and exposed to the electron source. A display array with a number of parallel conductive phosphor stripes for generating visible radiation when bombarded with electrons is arranged between the electron gating grid and the front panel. The display has a control unit for applying an accelerating voltage $V_3$ to the conductive phosphor stripes, and an arrangement for selectively applying a blocking voltage $V_2$ and a gating voltage $V_1$ to the conductive filaments, such that gating voltage $V_1$ is simultaneously applied to an adjacent filament pair to pass the electrons in-between the adjacent filament pair, such that the electrons which pass are accelerated to impact and produce visible radiation on a segment of the active stripe corresponding to the projection on the active stripe of the gating distance d between said conductive filaments.

28 Claims, 5 Drawing Sheets

FLAT-PANEL MATRIX-TYPE LIGHT EMISSIVE DISPLAY

BACKGROUND—FIELD OF THE INVENTION

The present invention relates to the field of visual display indicators and display panels, and in particular to matrix-type light emissive displays employing electrons for illuminating the display screen through impinging on a fluorescent material contained in the display screen.

BACKGROUND—DESCRIPTION OF PRIOR ART

Fluorescent indicator lamps which indicate characters, signs, figures employing fluorescent material, e.g., a phosphor, which emits light when impinged by electrons are in prior art. Also, it is known to use such lamps to show data with characters or signs and figures in the form of dotted patterns. Generally, displays operating according to this technique employ an electron source called the cathode or cathodes. Also provided is a mechanism for controlling the electrons produced by the cathode and a phosphor target on which the electrons are caused to impinge to cause emission of visible light.

Typically, the phosphors are deposited on a matrix of positive electrodes called anodes. The anodes can be maintained at high positive voltages relative to the cathode to attract the negatively charged electrons. A control system is positioned between the cathodes and the anodes to determine which phosphor-coated element of the matrix is impinged with electrons to generate light.

The cathode ray tube (CRT) is a well-known display system operating according to the above principle. The electron source is a small surface area filament heated to temperatures ranging from 900 to 1,000° C. to produce free thermal electrons. These electrons are gathered and collimated into a beam by a control system equipped with electrostatic plates and/or electromagnetic beam control. The beam is focused on the display screen consisting of a phosphor-coated anode matrix. Images are created by performing a raster scan of the anode matrix. Typically, an electromagnetic or electrostatic deflection system is used for performing the raster scan.

The main disadvantage of the CRT is the large depth of the system due to the amount of beam deflection necessary to scan the entire display screen. In fact, the screen size is determined by that portion of a circle's circumference subtended by the deflection angle of the electron beam. This limits the screen size considerably for short CRT units. Therefore, to make a short CRT using the beam deflection system one has to use multiple beams set up to scan separate areas of the screen. Multiple cathodes and complex driving systems are required to coordinate the multiple scanning beams and thus produce an integrated image over a large surface.

An alternative method is to produce a supply of electrons over an area equal in size to the display area. In this situation the control system is a set of orthogonal electrodes which select electrons out of the large-area electron cloud for acceleration to a specific phosphor-coated anode in the anode matrix. Since this system does not depend on deflecting a beam the distance between the anodes and the cathodes can be short. Thus, the display can be of the flat-panel type.

Prior art controls for such flat-panel systems can consist of simple crossed electrodes as described in U.S. Pat. No. 4,368,404 to Daisyaku. Here thermal electrons are emitted from cathode filaments positioned behind grid thin wires which, in turn, are positioned behind anode thin wires. The grid thin wires and the anode thin wires are crossed when viewed from above. The fluorescent material is applied to the anode thin wires at the intersections of the thin grid wires and the anode thin wires.

This arrangement exhibits a geometrical problem in that the electrons have to pass around the grid wire to impinge on the corresponding intersection to generate light. In other words, the grid wire shadows the phosphor-coated portions of the anode wires. The electrons are scattered by the thin grid wires on their way to the anode and impinge on large portions of the anode wire on both sides of the intersection. In other words, the selected electrons are not focused and not confined to impinge only on the phosphor at the intersection of the electrodes. This results in low brightness and loss of definition. The addition of phosphor along longer sections of the anode wire would cause more diffuse light spots and lower resolution. Daisyaku proposes to circumvent this problem by producing microscopic holes in the grid wires at the intersections. Unfortunately, this renders the grid wires extremely fragile, difficult to manufacture, and costly.

This problem is solved by placing a set of crossed mesh electrodes to set up a positive field which is maximum at the intersection of the two electrodes. Exemplary solutions based on this approach are found in U.S. Pat. No. 4,193,014 to Nixon and U.S. Pat. No. 4,223,244 to Kishino et al. In particular, Nixon shows how to use two segmented mesh electrodes each consisting of separately addressable stripes. The stripes are mutually orthogonal and both are positively biased to pass the thermal electrons. In his solution the momentum of the electrons carries a portion of them past the crossed mesh electrodes. At that point the much higher field of the phosphor anode takes over and accelerates the electrons up to the energy required to cause light emission upon impinging on the phosphor. Kishino improves on this system by using position-selecting grids arranged between the cathode and the phosphor-coated anodes. In this system the sections are used to define a 5×7 matrix used to form alphanumeric characters. It should be noted that separate controls are required for each row and column of the alphanumeric unit selected.

The major drawback of this system is its relatively low efficiency and thus high power requirements. That is because many of the electrons hit the mesh of crossed grids and never make it to the anode. Additionally, mesh grids require complex suspension systems to support them and their addition further complicates the overall mechanical support structure.

A simpler approach calls for using a system of crossed grids which are actually strips of metal with through-holes. The through-holes are aligned with the phosphor-coated anode portions. Exemplary systems using through-holes for guiding thermal electrons are found in U.S. Pat. No. 5,015,912 to Spindt et al., and U.S. Pat. Nos. 3,935,499 and 3,622,828. The systems disclosed by Spindt et al. utilizes a cold cathode from which electrons are "ripped out" by applying a very high electric field to a gate. The gate is a metal strip with through-holes. In this arrangement the electrons come spraying outwards and are not focused by the gate. In order to confine electron emission to the pixels the distance between cathode and anode must be reduced to a few microns. Moreover, such small distances and large fields lead to shorts between the phosphor anodes and the cathode. In addition, Spindt et al. teach the use of pointed cathodes which are characterized by high and non-uniform wear. This causes reduced image quality and brightness variations across the display.

U.S. Pat. No. 3,935,499 is characterized by a very complicated system for obtaining multiple electron beams for scanning small sections of a flat-panel display. This is a very expensive and inefficient solution. The solution described in U.S. Pat. No. 3,622,828 essentially adds an electron multiplier to allow lower electron emission from the cathode in answer to the inefficiencies of passing electrons through holes in grids and meshes. Unfortunately, this complicates the system and makes it impossible to produce a high resolution display panel Furthermore, the system requires extremely precise alignment of tiny holes with emitter filaments providing the thermal electrons.

Some other techniques allow one to cross two grids or one grid with the phosphor anode strip. In this manner, when the grid is activated, only the part of the activated anode passing near the grid is impinged by electrons. The system with one grid is clearly simpler. These control structures have a greatly simplified support system in comparison to the mesh system, but electrons are still largely absorbed by the grid. This translates to much lower efficiency and, consequently, increased power requirements. In addition, forming through-holes and ensuring their alignment with the anodes is a complicated task.

In all presently known grid-controlled systems each grid must be separated from the next one by a minimum distance to prevent shorting between them. This minimum distance determines a maximum number of pixels per inch or resolution of the screen display. Thus, the more grids and guidance elements are positioned between the cathode supplying thermal electrons and the phosphor anode the lower the resolution and the higher the power requirements. This limitation generally applies to presently known systems which attempt to adapt fluorescent display technology to produce viable and efficient flat-panel displays.

OBJECTS AND ADVANTAGES OF THE INVENTION

In view of the shortcomings of prior art display systems, one of the objects of the present invention is to provide a flat-panel matrix-type light emissive display which uses thermal electrons and which is structurally simple. The process for manufacturing this display is simpler and does not require precise alignment procedures. Furthermore, the production costs are lower.

Another object of the invention is to increase the efficiency of such display and to thus lower the power requirements, thus making it economical to employ the display in a variety of low-power devices.

A further object of the invention is to increase the resolution of the display and to provide for simple and efficient process to dynamically vary the resolution.

These and other objects and advantages will become more apparent after consideration of the ensuing description and the accompanying drawings.

SUMMARY OF THE INVENTION

The objects and advantages of the invention are ensured by a flat-panel, matrix-type visible light emissive display which has an evacuated display housing with a back panel, side walls, and a planar front panel. The display has an electron source positioned at the back panel for providing a background of electrons. In a preferred embodiment a number of thermionic filaments serve as the electron source. An electron gating grid having a number of conductive filaments arranged in parallel and spaced by a gating separation d is positioned before the front panel and exposed to the electron source. A display array with a number of parallel conductive phosphor stripes or phosphor-coated conductive stripes for generating visible radiation when bombarded with electrons is arranged between the electron gating grid and the front panel such that the conductive filaments run approximately perpendicular to the conductive phosphor stripes or phosphor-coated conductive stripes. Further, the display has a control unit for applying an accelerating voltage $V_3$ to the conductive phosphor stripes or phosphor-coated conductive stripes, such that any stripe maintained at voltage $V_3$ turns to an active stripe.

Finally, the display has an arrangement for selectively applying a blocking voltage $V_2$ and a gating voltage $V_1$ to the conductive filaments, such that gating voltage $V_1$ is simultaneously applied to an adjacent filament pair to pass the electrons in-between the adjacent filament pair, such that the electrons which pass are accelerated to impact and produce visible radiation on a segment of the active stripe corresponding to the projection on the active stripe of the gating distance d between said conductive filaments. Thus each segment represents a pixel of the flat-panel matrix-type visible light emissive display of the invention. In a preferred display the conductive phosphor stripes or phosphor-coated conductive stripes are conveniently embedded in the planar front panel. Further, a method is disclosed for operating a display of the type described.

A better understanding of the invention will be gained upon reading the following specification which makes references to the attached drawing figures.

DESCRIPTION

Figure 1:
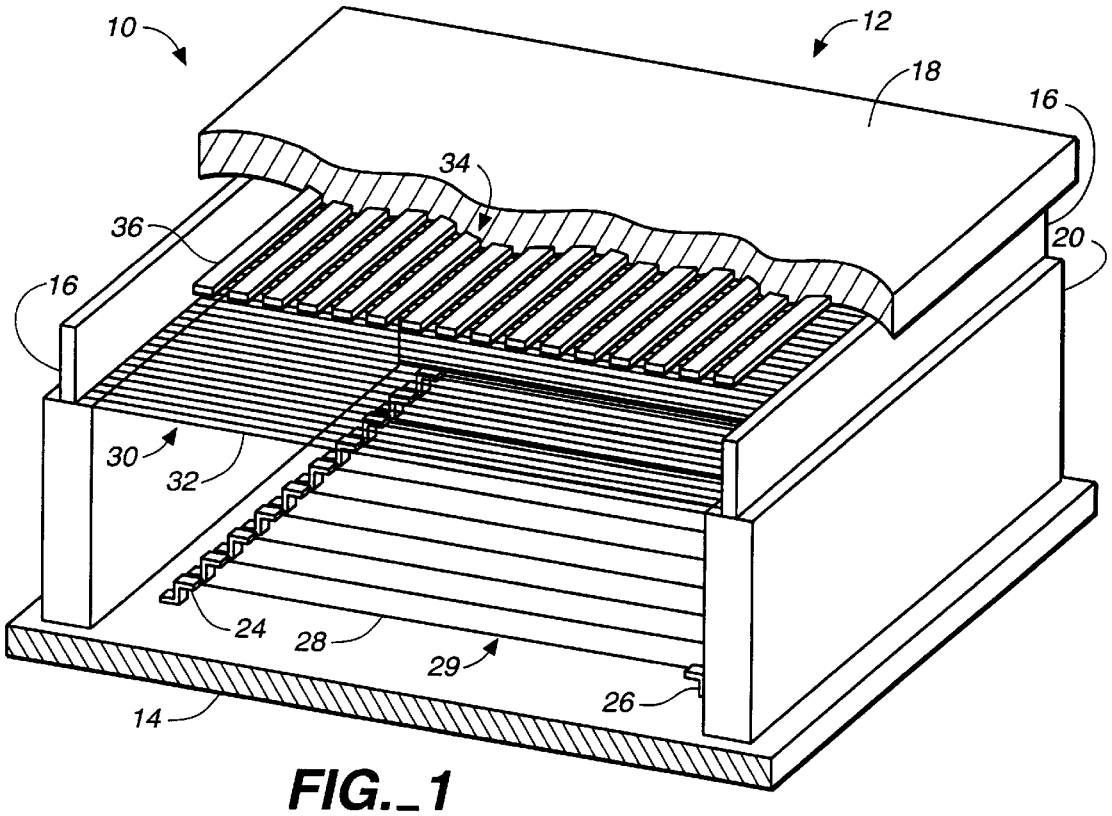
FIG. 1 is a perspective view of a preferred embodiment flat-panel matrix-type display according to the invention.

The perspective view in FIG. 1 shows a preferred embodiment of a flat-panel matrix-type display 10 according to the invention. Display 10 has an evacuated display housing 12 consisting of a back panel 14, side walls 16, which are supported on spacers 20, and a planar front panel 18. It is important for the operation of display 10 that housing 12 be free of particles. This is achieved by drawing a vacuum on the order of $10^{-5}$ Torr or less inside housing 12. In fact, the higher the vacuum the more reliable the display.

Inside housing 12 on back panel 14 along two opposite spacers 20 are mounted filament holders or springs 24 and 26. To each spring 24 on the left side of housing 12 corresponds a spring 26 on the right side. Thermionic filaments 28 are strung between each pair of springs 24 and 26. Thermionic filaments 28 are kept taut and, in the preferred embodiment, parallel to each other. It is convenient to guide thermionic filaments 28 between spacer 20 and back panel 14. (This makes it easy to establish electric connections to filaments 28). They thus form a thermionic filament array 29. In the preferred embodiment springs 26 are slightly taller than springs 24, so that thermionic filaments 28 are aslant with respect to back panel 14. This has the effect that thermionic filament array 29 is sloped with respect to back panel 14, for reasons which will be clarified below. In this arrangement thermionic filaments 28 can provide a background of electrons at back panel 14 when a sufficient voltage is applied to heat them above a critical temperature.

Above thermionic filaments 28 is located an electron gating grid 30 consisting of parallel conductive filaments 32. Thermionic filament array 29 is also sloped with respect to grid 30 because of the above-mentioned mounting method. In the embodiment shown conductive filaments 32 are strung between spacers 20 and side walls 16. This allows one to run electrical connections to filaments 32 directly on spacers 20 when required. This arrangement is preferred.

Figure 2:
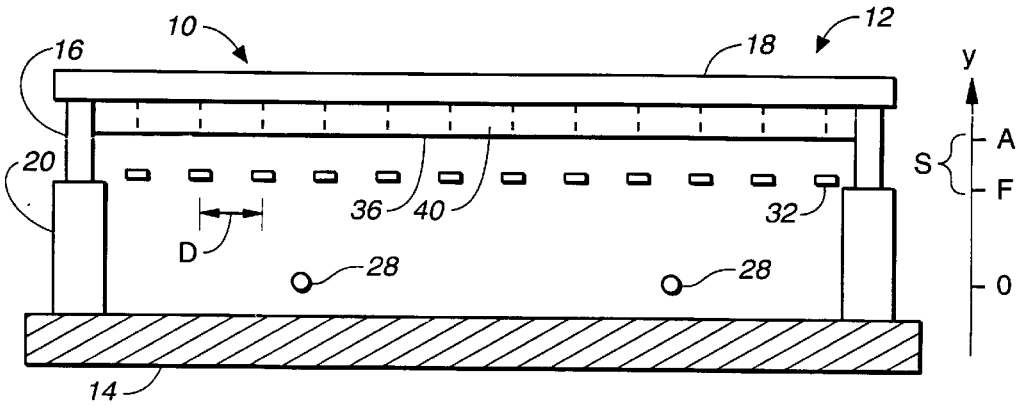
FIG. 2 is a cross-sectional side view of a simplified display according to the invention.
Figure 3:
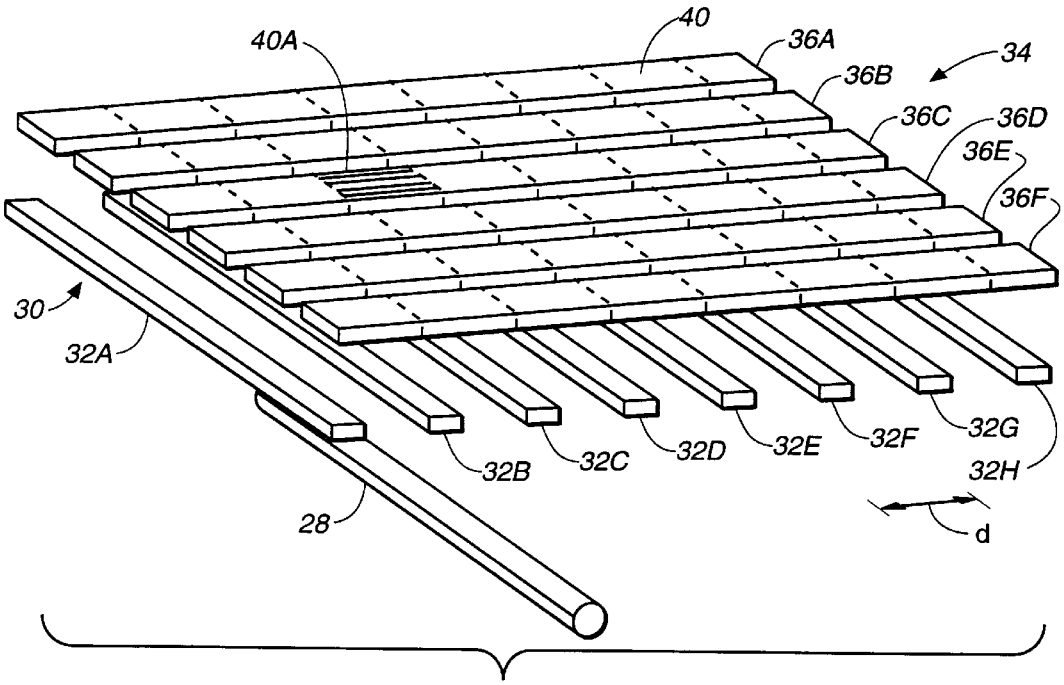
FIG. 3 is an isometric view of a cathode filament in relation to an electron gating grid and display array according to the invention.

Adjacent conductive filaments 32 are separated by a gating separation d. This is more clearly shown in FIGS. 2 and 3. FIG. 2 shows a cross-sectional side view of a simplified display with only twelve conductive filaments 32 and two thermionic filaments 28. FIG. 3 shows a number of conductive filaments 32 above one thermionic filament 28. Conductive filaments 32 are designed for a range of positive and negative voltages. Although the cross section of conductive filaments 32 is rectangular in both drawings any other cross section is permissible, e.g., circular.

In the preferred embodiment each thermionic filament 28 corresponds to six conductive filaments 32. This ratio can be changed to provide for more or fewer thermal electrons depending on the brightness desired and efficiency of thermionic filaments 28 in generating electrons. For example, to ensure a high background of electrons each thermionic filament 28 can correspond to one conductive filament 32. It is also possible that each thermionic filament 28 supplies electrons to more than six conductive filaments 32.

A person skilled in the art will be able to select the best number of filaments 28 on the basis of physical parameters discussed below. First, the filaments will be heated to 600° to 700° C. during operation. Any higher temperatures are undesirable since they would cause filaments 28 to glow and interfere with proper operation of display 10. In the preferred embodiment the filament base is a 0.001 inch tungsten/rhenium wire. The wire is coated with a layer of (Ba,Sr,Ca)O≅≅the emissive material. Provided with all layers, the final diameter of filaments 28 is approximately 0.003 inches.

For a typical display with 1024 lines one can employ, e.g., 32 filaments 28 each of length 15.4 inches; their total surface area is 4.6 square inches or 30 $cm^2$. The current density which can be obtained is 27.3–1,932 $mA/cm^2$ for a total of 0.819–58 A of current for the display. The actual current density will depend on filament temperature and the work function, according to the Richardson equation for current density:

$$j = A_o T^2 \exp\left(\frac{W_f}{kT}\right),$$

where $W_f$ is the work function required to expel electrons out of filaments 28, $A_o$ is a constant equal to 120 $A/cm^{2}°K^2$ for the filament coating material, and T is the temperature. For the present type of filament $W_f$=1.65 eV. Of course, these are theoretical values. In practice not all electrons generated will reach stripes 36 and, thus, efficiencies of 5% or less are common.

Above grid 30 is positioned a display array 34 consisting of anode stripes or conducting phosphor stripes 36 positioned parallel to each other. The distance between stripes 36 depends on the desired resolution and size of display 10. For example, to obtain a color (RGB) VGA 10" display stripes 36 are 3.2 mil wide and the distance between them is 1 mil. Preferably, the spacing S between grid 30 and array 34 is at least 0.03 inches. It can be less, under the condition that spacing S remains much larger than grid separation d (S>>d). In this manner, voltages applied to conductive filaments 32 are not annulled by the higher voltages which need to be applied to stripes 36 during operation to achieve light emission.

Stripes 36 are arranged perpendicular to conductive filaments 32. As a consequence, when looking from above, an adjacent pair of filaments 38 from among the conductive filaments 32 delimits a segment 40 on each stripe 36. Individual segments 40 are indicated by the dotted lines in FIGS. 2 and 3. The size of each segment 40 corresponds to gating distance d. In other words, each segment 40 is the projection of the gating distance d onto stripe 36.

Referring back to FIG. 1, display array 34 is shown to be embedded in front panel 18. In this case front panel 18 is in fact the display screen. Since voltages have to be applied to individual stripes 36 the material of which front panel 18 is made has to be an electrical insulator.

Selecting the appropriate materials, thickness, coating layers, and other attributes of front panel 18 to render it a practical display screen are within the knowledge of one skilled in the art. Materials well-suited for this purpose include glass or plastics capable of supporting a vacuum. Also, stripes 36 do not have to be embedded in front panel 18. As shown in FIG. 2, they can be located underneath front panel 18.

Figure 4:
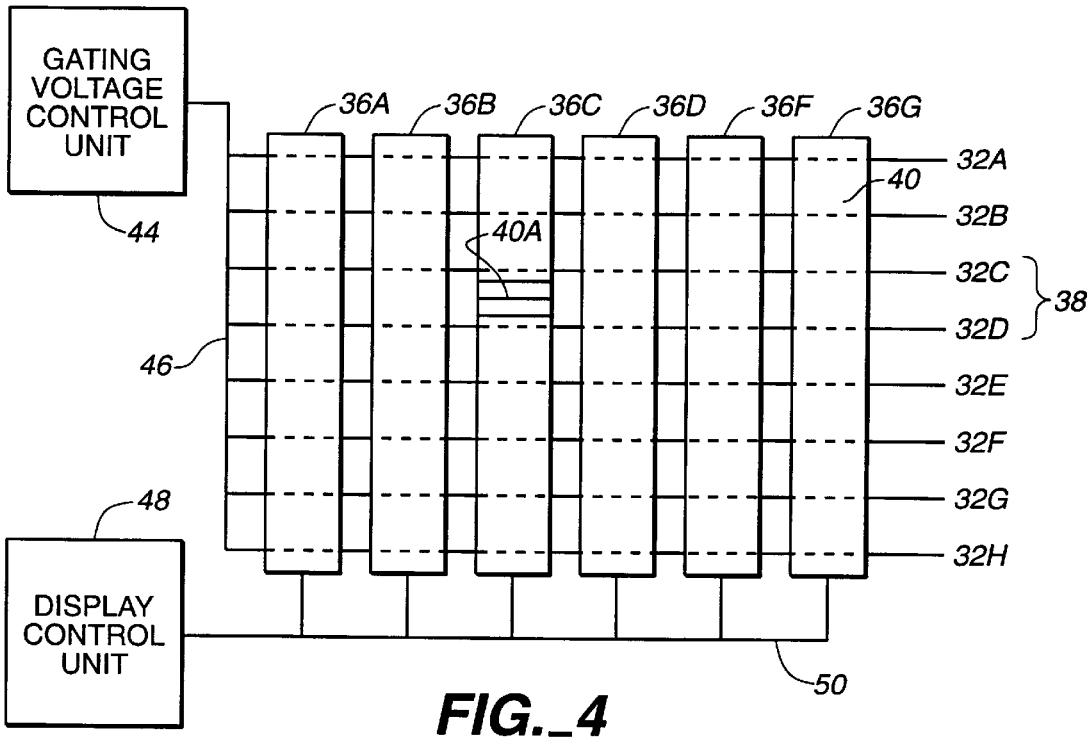
FIG. 4 is a diagram illustrating the operation of the display according to the invention.

FIG. 4 illustrates the electrical connections and controls required to operate display 10. A gating voltage control unit 44 is connected by a lead 46 to conductive filaments 32. For clarity conductive filaments 32 have been designated by references 32A through 32H. Control unit 44 is designed to supply two voltages, a blocking voltage $V_2$ and a gating voltage $V_1$. Typically, blocking voltage $V_2$ ranges between −10 and +5 Volts and gating voltage $V_1$ lies between +5 and +150 Volts. Control unit 44 is designed to apply gating voltage $V_1$ simultaneously to an adjacent filament pair of conductive filaments 32 while applying blocking voltage $V_2$ to other filaments 32. In this example the adjacent filament pair is 32C and 32D. At the same time blocking voltage $V_2$ is applied to all other conductive filaments 32A, 32B and 32E through 32H.

A display control unit 48 is connected by lead 50 to stripes 36. For clarity stripes 36 have been designated by references 36A through 36G. Display control unit 48 is designed to apply an accelerating voltage $V_3$ to any stripe 36A through 36G. Application of accelerating voltage $V_3$ renders the corresponding stripe, in the example of FIG. 4 stripe 36C, a live or active stripe as long as it is maintained at $V_3$. Accelerating voltage $V_3$ has to be sufficiently high to accelerate electrons in the vicinity of active stripe 36C to produce visible radiation when the electrons interact with phosphor 42 of stripe 36C on impact. Typically voltages between +18 and +150 Volts are sufficient for this purpose, depending on the conductivity of phosphor 42 and the desired brightness. The well-known low-voltage phosphors satisfy these requirements. Nonetheless, it is possible to use voltages to +1,000 V, or higher, for various phosphor requirements.

Figure 5:
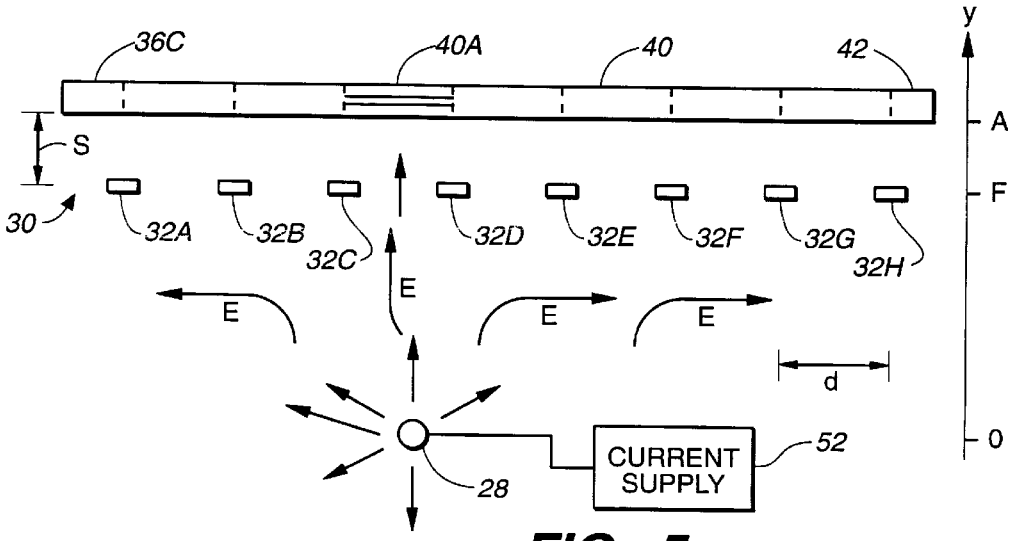
FIG. 5 is a diagram illustrating the passage of electrons between an adjacent filament pair.

FIG. 5 illustrates the essential parts shown in FIG. 4 from a side view. The arrows designated by the letter E indicate trajectories of thermal electrons generated by thermionic filament 28. A current supply 52 is shown connected to thermionic filament 28A for passing a current through it to induce emission of thermal or low-energy electrons. In fact, supply 52 is connected to all thermionic filaments 28 (not shown) to perform the same function. A typical filament voltage $V_f$ is +3.0 Volts. In the case of a simple DC filament bias the positive end of the filament subtracts from the available acceleration voltage supplied to stripe 36. The actual voltage will depend on the resistance of the particular filament. In the present embodiment the voltage drops from right to left (as seen in FIG. 1). To compensate for this drop springs 26 are taller to hold up portions of filaments 28 at lower voltage closer to grid 30. When supply 52 heats filaments 28 with an AC current, then no filament slant is required. The advantages and disadvantages of slanted DC filaments and parallel AC filaments depend on the particular design parameters and can be determined by a person skilled in the art in each particular case.

Figure 10:
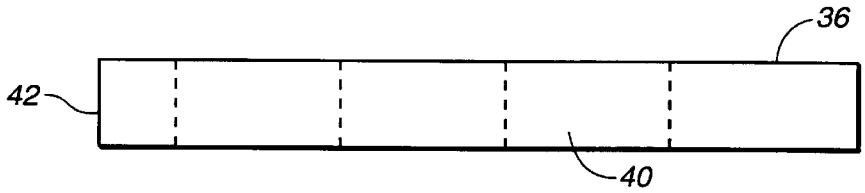
FIG. 10 is a cross-sectional view of a conductive phosphor stripe.

In the preferred embodiment stripes 36 are made of an electrically conductive phosphor 42, as shown in FIG. 10. Phosphor 42 can be admixed with other well-known materials to ensure that stripes 36 have the required mechanical stability. In order to create color displays phosphor 42 can be selected from among $Zn_3(PO_4)$:Mn, (Zn,Cd)S:Ag, $Y_2O_2S$:Eu, $Y_2(WO_4)_3$:Eu and the like to produce red light. Green light can be generated by phosphors such as $InBO_3$, $Y_3Al_5O_{12}$:Tb, $Gd_2O_2S$:Tb, and ZnS:Cu,Al and blue light can be produced by ZnS:Ag or $Y_2SiO_5$:Ce. A person skilled in the art will be able to select these and other appropriate phosphors to produce a color display in accordance with the invention.

Operation of the Preferred Embodiment

The operation of the preferred embodiment will be best understood by initially referring to FIG. 2. Display 10 requires a background of low-energy electrons at back panel 14. To generate the background electrons filaments 28 are supplied with current from current supply 52 (see FIG. 5). This causes Joule heating of filaments 28 and induces them to emit thermal electrons. These are very low-energy electrons traveling in all directions as indicated by the arrows, to populate the space at back panel 14.

Once a background of electrons is provided display 10 can be illuminated. For purposes of illustration we will assume that we want to illuminate a particular segment 40A of segments 40 on stripe 36C between conductive filaments 32C and 32D. To do this gating voltage $V_1$, e.g., +20 Volts, is applied to adjacent filament pair 32C and 32D (also designated by reference 38 in FIG. 4) while blocking voltage $V_2$, e.g., −5 Volts, is applied to the other conductive filaments 32A, 32B, and 32E through 32H. At the same time stripe 36C is maintained at accelerating voltage $V_3$, e.g., between +30 and +150 Volts. In fact, the lower limit on acceleration voltage $V_3$ is imposed by the requirement that it be higher than gating voltage $V_1$.

As the electrons move in the direction of gating grid 30 they initially only "see" blocking voltage $V_2$ and gating voltage $V_1$. In other words, accelerating voltage $V_3$ applied to stripe 36C is obscured or shielded by voltages on grid 30. Blocking voltage $V_2$ presents a high potential barrier to the electrons. The thermal electrons do not have sufficient energy to overcome this barrier.

Figure 6:
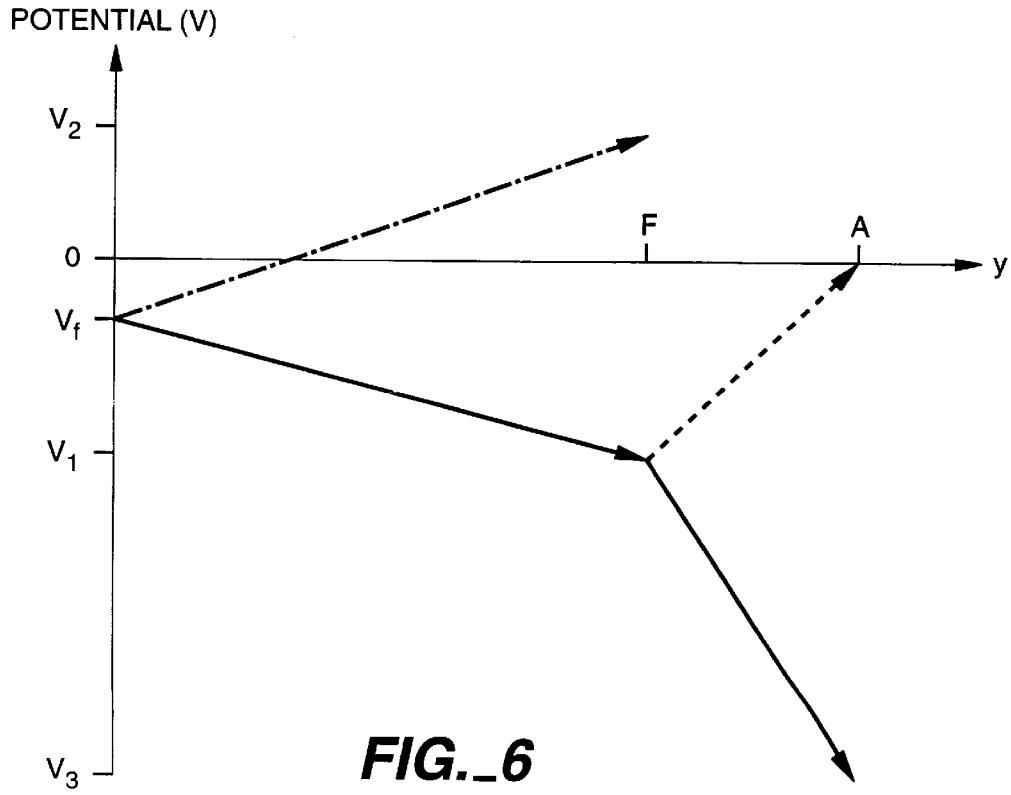
FIG. 6 is a graphical diagram showing the potential encountered by electrons traveling from a thermionic filament to a conductive stripe.

The graph in FIG. 6 illustrates with a dotted and broken arrow the barrier encountered by an electron approaching along the y-axis conductive filament 32 maintained at blocking voltage $V_2$, e.g., conductive filament 32A, 32B, or 32E through 32H. Since electrons are negatively charged and positive voltages attract them, the graph is inverted, with the highest positive potential, accelerating voltage $V_3$, charted lowest on the potential axis. For reference, the potential of thermionic filament 28 is located at $V_f$, approximately +3 Volts. Of course, $V_f$ drops off to 0 Volts over the length of the filament as discussed above. Point F denotes the position of grid 30 and point A indicates the location of the surface of stripe 36C. Since the potential increases from $V_f$ to $V_2$ by more energy than the electron has, the blocking potential effectively deflects a low-energy electron. The electron is forced to change its path, as illustrated by arrows E in FIG. 5.

Meanwhile, a low-energy electron approaching adjacent filament pair 32C or 32D "sees" gating voltage $V_1$ on both filaments. The corresponding potential variation along its path is visualized by the solid arrow in the graph of FIG. 6. Clearly, the electron approaching conductive filament 32C or 32D will not be deflected. Rather, it will be inclined to pass in-between adjacent filament pair 32C and 32D. Thus, adjacent filament pair 32C and 32D effectively represent a gate through which electrons can slip towards stripe 36C, as shown by corresponding arrows in FIG. 5.

The dotted arrow in FIG. 6 represents the path of an electron exactly between two conductive filaments maintained at gating potential $V_1$ to one of stripes 36, e.g., stripe 36B which is not activated and remains at 0 Volts. Again, the electron will not have enough energy to get to stripe 36B and generate light on impact.

Once past grid 30, the electrons experience accelerating voltage $V_3$ of stripe 36C. This potential is higher than gating voltage $V_1$, as discussed above. Consequently, electrons which pass in-between adjacent filament pair 32C and 32D are accelerated to impact on segment 40 of stripe 36C corresponding to adjacent filament pair 32C and 32D. For convenience, the particular segment in this example is labeled as segment 40A. The size of segment 40A substantially corresponds to the projection of gating distance d on stripe 36C. That is because electrons can pass at all locations between conductive filaments 32C and 32D. The slight scattering and deflection which some electrons undergo in passing in-between adjacent filament pair 32C and 32D tends to increase the size of segment 40A.

In fact, segment 40A corresponds to a pixel of display 10. The brightness of pixel 40A, or any other pixel 40, is governed by the amount of time the pixel is exposed to electron bombardment. This is due to the fact that electron bombardment delivers energy per unit time to the phosphor, and phosphor brightness is delivered energy the total delivered energy. In an operating display images are delivered at sixty frames per second. A VGA display, for example, has 480 pixel lines. Therefore, each line is on for 1/60th×1/480th of a second or 35 μs. The highest brightness will be achieved when the anode is on for the full 35 μs.

The size of pixel 40A or its sharpness can be adjusted by correspondingly varying blocking voltage $V_2$, gating voltage $V_1$, and accelerating voltage $V_3$. For best results the actual voltages should be chosen based on a few calibration runs.

Pixel size along stripe 36 depends only on gating separation d between conductive filaments 32. Moreover, separation d can be arbitrarily small. The resolution of display 10 is higher than for prior art displays discussed in the introduction, because two conductive filaments 32 having a gating separation d define a single grid element. Prior art required the use of a single conductive element with through-holes. The resolution of such devices is determined by the width of the element with the through-hole and the required separation between the elements. The present invention eliminates the through-hole and corresponding restrictions on the separation between the elements. Thus, the only limitation on resolution is the spacing between neighboring stripes 36, as discussed above. One should also ensure, that this separation should be large enough to prevent electric brake-down between stripes 36 (e.g., when one stripe is active and the adjacent stripe is off).

The full advantage of the present invention will be appreciated by observing how display 10 is operated. Based on the above, gating voltage $V_1$ is applied to successive pairs of conductive filaments 32 thus activating corresponding stripes 36 on which a pixel is to be displayed. Each successive filament pair should use one conductive filament of the previous adjacent filament pair. In the example discussed, conductive filaments 32B and 32C or conductive filaments 32D and 32F should constitute the successive filament pair. Now the distance between pixels is just the thickness of conductive filaments 32, which can be exceedingly fine (since no through-holes are required). In this manner the entire screen or front panel 18 can be scanned.

Uniform brightness across the screen is enhanced by the sloping of thermionic filament array 29 with respect to grid 30. Since there is a voltage drop along each thermionic filament 28, electrons emitted at locations where the voltage is higher will have less kinetic energy. Conversely, electrons emitted at location where the voltage is lower will have higher kinetic energies. Slanting of thermionic filament array 29 ensures that the lower-energy electrons are closer to grid 30 and higher-energy electrons further away. This guarantees that the same amount of kinetic energy per unit time arrives at grid 30.

The time it takes for electrons to reach grid 30 from filaments 28 is given by:

$$t = \sqrt{\frac{2 \cdot x}{a}},$$

where t is the time of flight, x is the distance from filament 28 to grid 30, and a is the acceleration of the electron. Electron power $P_e$ is dependent on the vacuum resistance and the voltage difference between filament 28 and conductive filaments 32 of grid 30. It is expressed by:

$$P_e = \frac{V_g^2}{R_{vac}},$$

where $V_g$ is the voltage difference between gating voltage $V_1$ and filament voltage $V_f$ and $R_{vac}$ is the vacuum resistance. Since adjacent pairs of conductive filaments 32 are only turned on for short periods of time, e.g., 35 μs, high-energy electrons would pass through in regions where filament voltage $V_f$ is lower. Consequently, the filament has to be slanted to shorten the time of flight, so that more low-energy electrons get through. In fact, the amount of slant, expressed as a difference in height between the right and left sides of thermionic filament array 29 can be determined. To do this one has to choose $x_1$, the height of array 29 on the left, and $x_2$, the height of array 29 on the right such that:

$$\frac{V_1^2 \cdot \sqrt{2 \cdot \frac{x_1^2}{V_1 \cdot q} \cdot m_e}}{(V_1 - V_f)^2 \cdot \sqrt{2 \cdot \frac{x_2^2}{(V_1 - V_f) \cdot q} \cdot m_e}} = 1$$

In this condition me stands for electron mass and q is the electron charge. This equation can be solved by numerically adjusting $x_1$ and $x_2$.

Typical VGA displays have 480 lines and 640 columns yielding 307,200 pixels. In the display of the invention operating 480 lines requires 481 conductive filaments 32 for 480 successive adjacent filament pairs and 640 stripes 36. The scan needs to be performed in 1/60 of a second or less. This ensures that the display is painted 60 times each second and the eye does not perceive flickering.

For a full color display the phosphors in stripes 36 need to be appropriately chosen to produce the colors red, green, and blue upon electron bombardment. Typically, a matrix with red, green, and blue pixels adjacent to each other is selected for this purpose. A person skilled in the art will know how to make the appropriate choices.

The present invention thus provides a flat-panel matrix-type light emissive display which uses thermal or low-energy electrons and which is structurally simple. With the exception of grid 30, there are no meshes or other electron guidance or amplification devices interposed between the electron source and the anodes or stripes 36. This renders display 10 easy to manufacture. Precise alignment procedures are not required since there are no through-holes or shadow masks which need to be precisely adjusted with respect with vital screen elements. Consequently, the production costs are low.

Display 10 is also highly energy efficient by virtue of using low voltages and currents. The total power consumption for a VGA unit is on the order of a few Watts, making it a viable display for portable devices such as laptop computers and other low-power devices.

Thermionic filaments 28 used as sources of electrons in the preferred embodiment produce an additional advantage. In particular, large-surface filaments are cooler than point sources. They are thus less subject to wear.

Alternative Embodiments

Figure 11:
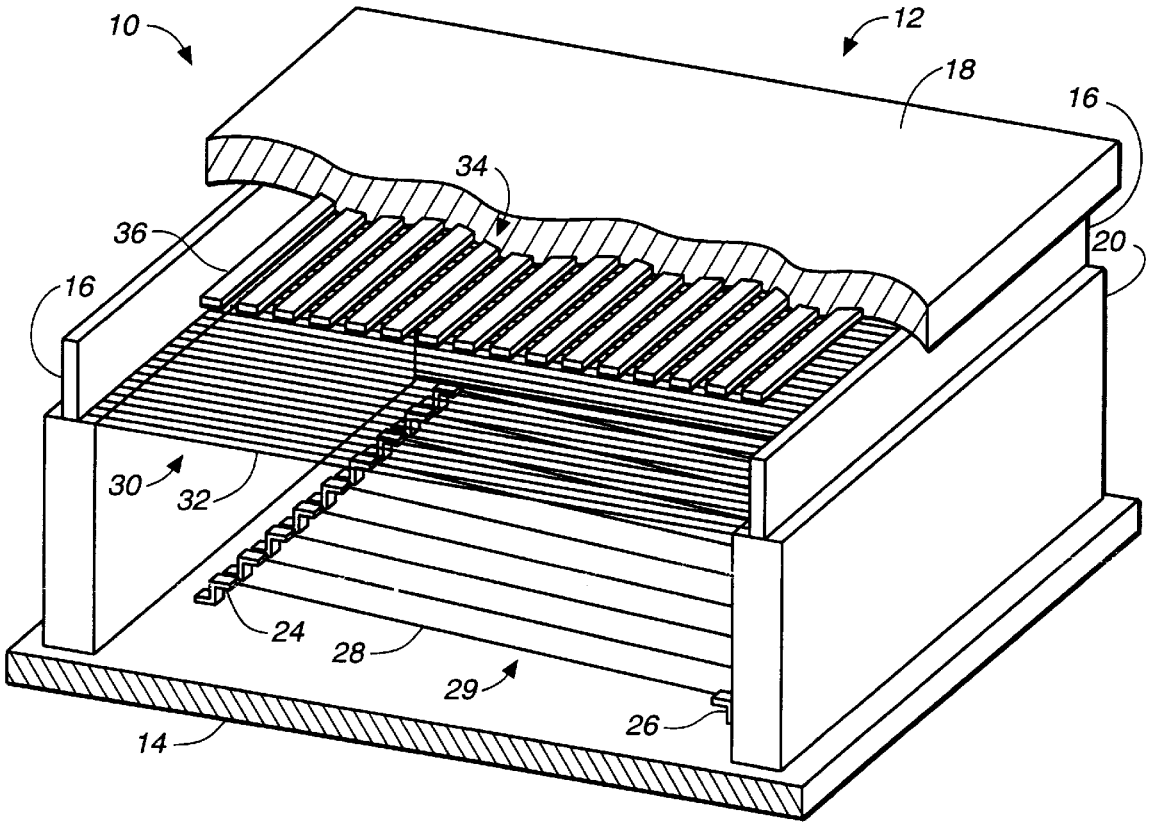
FIG. 11 is a perspective view of a display according to the invention using a different arrangement of thermionic filaments.

The preferred embodiment discussed above is merely one of many possible physical display systems incorporating the present invention. Many changes can be introduced within scope of the invention. In an alternative display, analogous in all respects to the preferred embodiment, thermionic filaments 28 are not oriented parallel to conductive filaments 32. This is illustrated in FIG. 11, where filaments 28 are aslant with respect to conductive filaments 32 of grid 30. It is only essential that filaments 28 produce a background of low-energy electrons. For best results filaments 28 are uniformly spaced with respect to each other. The operation of this embodiment is analogous to the operation of the preferred embodiment.

Figure 7:
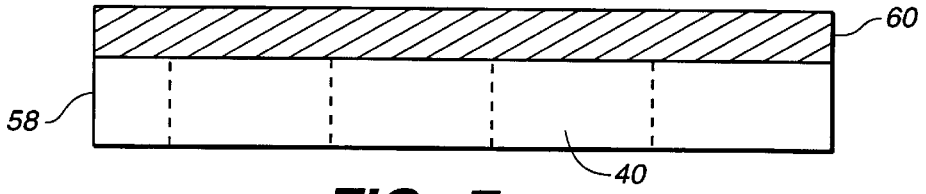
FIG. 7 is a cross-sectional view of a phosphor-coated conductive stripe.

In another embodiment of the invention display array 34 uses a phosphor-coated conductive stripe 58. In fact, depending on the application, phosphor-coated conductive stripe 58 may be preferable to conductive phosphor stripe 36. For one, a phosphor-coated stripe may permit one to operate the display at lower voltages and thus reduce the power requirements. FIG. 7 shows conductive stripe 58 in a side view. Preferably, the material of which conductive stripe 58 is made either of ITO or similar materials known in the art. A phosphor 60 selected from the group of red light emitting phosphors, green light emitting phosphors, or blue light emitting phosphors and covers the entire surface of conductive stripe 58.

In this embodiment display control unit 48 is set up to maintain accelerating voltage $V_3$ in conductive stripe 58. Consequently, phosphor 60 can also be chosen from among non-conducting phosphors. In all other aspects, this embodiment is analogous to the preferred embodiment.

Figure 8:
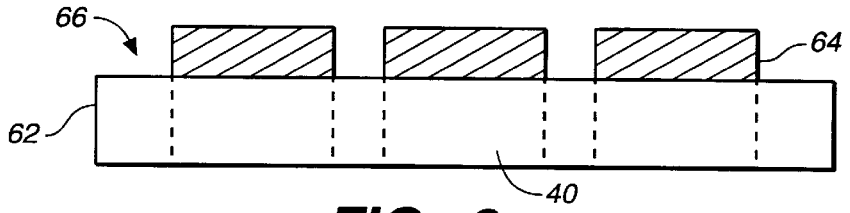
FIG. 8 is a cross-sectional view of a point-wise phosphor-coated conductive stripe.

Yet another embodiment of a phosphor-coated conductive stripe 62 is shown in FIG. 8. In this case phosphor 60 can also be chosen from the group of red light emitting phosphors, green light emitting phosphors, or blue light emitting phosphors. It can also be selected among non-conducting phosphors. In contrast to the above embodiment, phosphor 60 is coated point-wise on conductive stripe 62. In particular, phosphor points 66 are applied on segments 40 to correspond to gating distance d. A small separation is preserved between points 66 to prevent accidental activation of adjacent pixels. In fact, the minimum separation is dictated by break-down voltages between adjacent pixels. This predetermines the size of pixels 40.

Figure 9:
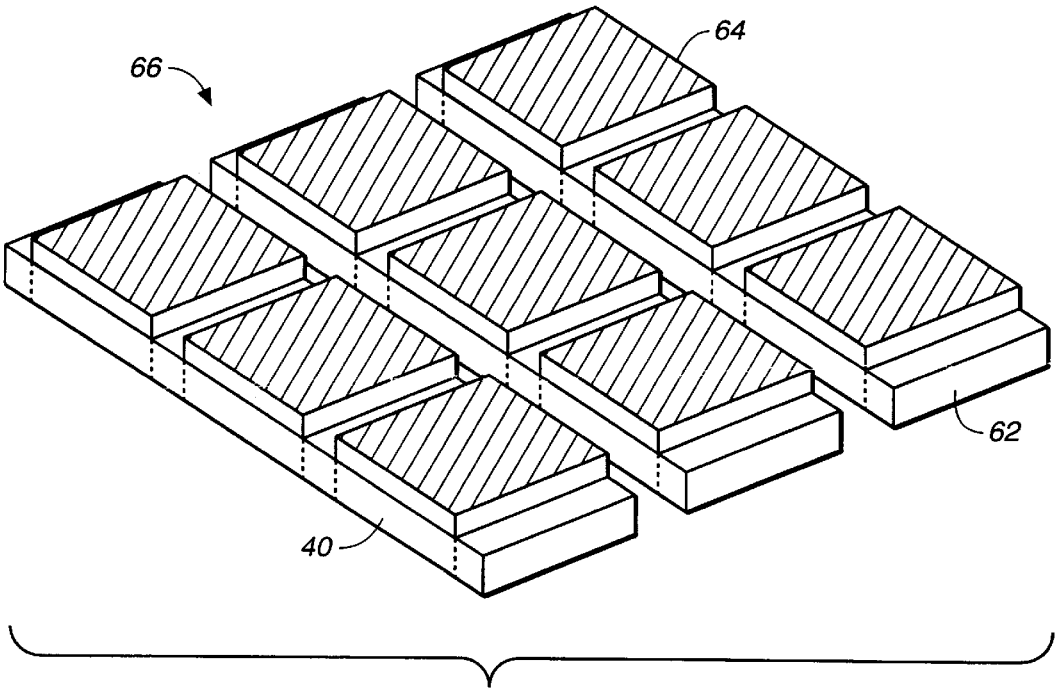
FIG. 9 is a perspective view of several conductive stripes as shown in FIG. 8

FIG. 9 shows three point-wise coated conductive stripes 62. The advantage of this embodiment is that the pixel size is controlled and uniform. This means that adjustments of gating, blocking, and accelerating voltages do not need to be as precise.

In yet another embodiment of the display white phosphors are used in conjunction with red, green, and blue color filters. Color filters are situated between the back of the white phosphor stripe and the front plate to give a full color display. This filter-based approach is presently utilized by display manufacturers. The knowledge necessary to incorporate these changes is well-known to those skilled in the art.

Summary, Ramifications, and Scope

The presented invention is not limited by the embodiments discussed above. While preserving the essential feature of the "bi-filar" gating of electrons, many elements of display 10 can be exchanged. For example, any planar source of electrons can be used as a supply of the low-energy electrons. Also, in all embodiments the phosphor can be contained in the bulk of the conductive stripe or on the side exposed to the electrons, rather than on top. The geometrical arrangement of the grid, filaments, and stripes can be altered as well, although the perpendicular orientation has always been preferred in the art.

Therefore, the scope of the invention should be determined, not by examples given, but by the appended claims and their legal equivalents.

We claim:

1. A flat-panel, matrix-type visible light emissive display comprising:

a) an evacuated display housing having a back panel, side walls, and a planar front panel;

b) an electron source for providing a background of low-energy electrons at said back panel;

c) an electron gating grid having a plurality of conductive filaments arranged in parallel and spaced by a gating separation d, said electron gating grid being positioned before said front panel and exposed to said background of low-energy electrons;

d) a display array having a plurality of conductive phosphor stripes for generating visible radiation when bombarded with electrons, said conductive phosphor stripes being arranged in parallel to one another, said display array being positioned between said electron gating grid and said front panel such that said conductive filaments run approximately perpendicular to said conducting phosphor stripes;

e) means for applying a variable accelerating voltage $V_3$ maintained to said conductive phosphor stripes, to select between an actively enabled state and an actively disabled state on each said conductive phosphor stripe; and f) means for selectively applying a blocking voltage $V_2$ and a gating voltage $V_1$ to said conductive filaments, such that said gating voltage $V_1$ is simultaneously applied to an adjacent filament pair of said conductive filaments to pass the low-energy electrons in-between said adjacent filament pair, such that the low-energy electrons which pass in-between said adjacent filament pair are accelerated to impact and produce visible radiation on a segment of said conductive phosphor stripe in said actively enabled state substantially corresponding to the projection on said conductive phosphor stripe in said actively enabled state of said gating distance d between said conductive filaments, said segment representing a pixel of said flat-panel, matrix-type visible light emissive display.

2. The visible light emissive display of claim 1, wherein said conductive phosphor stripes are embedded in said planar front panel.

3. The visible light emissive display of claim 1, wherein said electron source comprises:

a) a plurality of thermionic filaments arranged at the back panel of said evacuated display housing; and b) means for passing sufficient current through said plurality of thermionic filaments to induce emission of low-energy electrons.

4. The visible light emissive display of claim 3, wherein said thermionic filaments are arranged in a thermionic filament array where said thermionic filaments extend parallel to each other, and such that said thermionic filament array is sloped with respect to said electron gating grid.

5. The visible light emissive display of claim 4, wherein each one of said thermionic filaments corresponds to more than one of said conductive filaments.

6. The visible light emissive display of claim 1, wherein said electron source comprises a plurality of cold cathodes arranged at the back panel of said evacuated display housing.

7. The visible light emissive display of claim 1, wherein said electron source is geometrically planar.

8. The visible light emissive display of claim 1, wherein said accelerating voltage $V_3$ is comprised between +30 and +200 Volts.

9. The visible light emissive display of claim 1, wherein said blocking voltage $V_2$ is comprised between −10 and +5 Volts, and said gating voltage $V_1$ is comprised between +5 and +150 Volts.

10. The visible light emissive display of claim 1, wherein said conductive phosphor stripes comprise phosphors selected from the group consisting of red light emitting phosphors, green light emitting phosphors, and blue light emitting phosphors.

11. A flat-panel, matrix-type visible light emissive display comprising:

a) an evacuated display housing having a back panel, side walls, and a planar front panel;

b) an electron source for providing a background of low-energy electrons at said back panel;

c) an electron gating grid having a plurality of conductive filaments arranged in parallel and spaced by a gating separation d, said electron gating grid being positioned before said front panel and exposed to said background of low-energy electrons;

d) a display array having a plurality of phosphor-coated conductive stripes for generating visible radiation when bombarded with electrons, said phosphor-coated conductive stripes being arranged in parallel to one another, said display array being positioned between said electron gating grid and said front panel such that said conductive filaments run approximately perpendicular to said phosphor-coated conductive stripes;

e) means for applying a variable accelerating voltage $V_3$ maintained to said phosphor-coated conductive stripes, to select between an actively enabled state and an actively disabled state on each said phosphor coated conductive stripe; and f) means for selectively applying a blocking voltage $V_2$ and a gating voltage $V_1$ to said conductive filaments, such that said gating voltage $V_1$ is simultaneously applied to an adjacent filament pair of said conductive filaments to pass the low-energy electrons in-between said adjacent filament pair, such that the low-energy electrons which pass in-between said adjacent filament pair are accelerated to impact and produce visible radiation in the phosphor on a segment of said phosphor-coated conductive stripe in said actively enabled state substantially corresponding to the projection on said phosphor-coated conductive stripe of said gating distance d between said conductive filaments, said segment representing one of the pixels of said flat-panel, matrix-ype visible light emissive display; wherein said phosphor-coated conductive stripes are embedded in said planar front panel.

12. The visible light emissive display of claim 11, wherein said electron source comprises:

a) a plurality of thermionic filaments arranged at the back panel of said evacuated display housing; and b) means for passing sufficient current through said plurality of thermionic filaments to induce emission of low-energy electrons.

13. The visible light emissive display of claim 12, wherein said thermionic filaments are arranged in a thermionic filament array where said thermionic filaments extend parallel to each other, and such that said thermionic filament array is sloped with respect to said electron gating grid.

14. The visible light emissive display of claim 13, wherein each one of said thermionic filaments corresponds to more than one of said conductive filaments.

15. The visible light emissive display of claim 11, wherein said electron source comprises a plurality of cold cathodes arranged at the back panel of said evacuated display housing.

16. The visible light emissive display of claim 11, wherein said electron source is geometrically planar.

17. The visible light emissive display of claim 11, wherein said accelerating voltage $V_3$ is comprised between +30 and +200 Volts.

18. The visible light emissive display of claim 11, wherein said blocking voltage $V_2$ is comprised between −10 and +5 Volts, and said gating voltage $V_1$ is comprised between +5 and +150 Volts.

19. The visible light emissive display of claim 11, wherein said phosphor-coated conductive stripes comprise phosphors selected from the group consisting of red light emitting phosphors, green light emitting phosphors, and blue light emitting phosphors.

20. The visible light emissive display of claim 11, wherein the phosphor on said phosphor-coated conductive stripes is coated point-wise such that each point of phosphor corresponds to one of the pixels.

21. The visible light emissive display of claim 11, wherein the phosphor on said phosphor-coated conductive stripes is coated on the entire conductive stripe.

22. The visible light emissive display of claim 11, wherein said phosphor-coated conductive stripe comprises a conductive material made of ITO.

23. A method for driving a flat-panel, matrix-type visible light emissive display of the type having an evacuated display housing having a back panel, side walls, a planar front panel, an electron gating grid comprising a plurality of conductive filaments arranged in parallel and spaced by a gating separation d, said electron gating grid being positioned before said front panel, said visible light emissive display further having a display array having a plurality of conductive phosphor stripes for generating visible radiation when bombarded with electrons, said conductive phosphor stripes being arranged in parallel to one another, said display array being positioned between said electron gating grid and said front panel such that said conductive filaments run approximately perpendicular to said conductive phosphor stripes, said method comprising the following steps:

a) providing a background of low-energy electrons at said back panel;

b) selectively applying a blocking voltage $V_2$ and a gating voltage $V_1$ to said conductive filaments, such that said gating voltage $V_1$ is simultaneously applied to an adjacent filament pair of said conductive filaments to pass the low-energy electrons in-between said adjacent filament pair;

c) applying an accelerating voltage $V_3$ to said conductive phosphor stripes, such that any of said conductive phosphor stripes maintained at said accelerating voltage $V_3$ turns to an active stripe, and such that the low-energy electrons which pass in-between said adjacent filament pair are accelerated to impact and produce visible radiation on a segment of said active stripe substantially corresponding to the projection on said active stripe of said gating separation d between said conductive filaments, said segment representing one of the pixels of said flat-panel, matrix-type visible light emissive display.

24. The method of claim 23, wherein said gating voltage $V_1$ is applied to said adjacent filament pair while said blocking voltage $V_2$ is applied to all other of said conductive filaments.

25. The method of claim 24, wherein each successive filament pair is selected to comprise one of said conductive filaments of said adjacent filament pair.

26. A method for driving a flat-panel, matrix-type visible light emissive display of the type having an evacuated display housing having a back panel, side walls, a planar front panel, an electron gating grid comprising a plurality of conductive filaments arranged in parallel and spaced by a gating separation d, said electron gating grid being positioned before said front panel, said visible light emissive display further having a display array having a plurality of phosphor-coated conductive stripes for generating visible radiation when bombarded with electrons, said phosphor-coated conductive stripes being arranged in parallel to one another, said display array being positioned between said electron gating grid and said front panel such that said conductive filaments run approximately perpendicular to said phosphor-coated conductive stripes, said method comprising the following steps:

a) providing a background of low-energy electrons at said back panel;

b) selectively applying a blocking voltage $V_2$ and a gating voltage $V_1$ to said conductive filaments, such that said gating voltage $V_1$ is simultaneously applied to an adjacent filament pair of said conductive filaments to pass the low-energy electrons in-between said adjacent filament pair;

c) applying an accelerating voltage $V_3$ to said phosphor-coated conductive stripes, such that any of said phosphor-coated conductive stripes maintained at said accelerating voltage $V_3$ turns to an active stripe, and such that the low-energy electrons which pass in-between said adjacent filament pair are accelerated to impact and produce visible radiation in the phosphor on a segment of said active stripe substantially corresponding to the projection on said active stripe of said gating separation d between said conductive filaments, said segment representing one of the pixels of said flat-panel, matrix-type visible light emissive display.

27. The method of claim 26, wherein said gating voltage $V_1$ is applied to said adjacent filament pair while said blocking voltage $V_2$ is applied to all other of said conductive filaments.

28. The method of claim 26, wherein each successive filament pair is selected to comprise one of said conductive filaments of said adjacent filament pair.

* * * * *